US006092348A

United States Patent [19]

Dombchik et al.

[11] Patent Number: 6,092,348

[45] Date of Patent: Jul. 25, 2000

[54] ALUMINUM FRAMING COMPONENTS AND COMPONENT SYSTEMS FOR POOL, PATIO AND GLASS ENCLOSURES AND THE LIKE

[75] Inventors: Barry N. Dombchik, Longwood; Terry L. Brownlee, North Port, both of Fla.

[73] Assignee: Florida Extruders International, Inc., Sanford, Fla.

[21] Appl. No.: 09/024,531

[22] Filed: Feb. 17, 1998

[51] Int. Cl.[7] ..... E04H 12/00

[52] U.S. Cl. ..... 52/653.1; 52/656.5

[58] Field of Search ..... 52/648.1, 653.1, 52/653.2, 655.1, 656.5, 204.71, 204.72

[56] References Cited

U.S. PATENT DOCUMENTS 5,644,881 7/1997 Neilly ..... 52/455
5,657,591 8/1997 Kitada ..... 52/204.71

*Primary Examiner*—Beth A. Stephan

*Attorney, Agent, or Firm*—Renner, Otto, Boisselle & Sklar, LLP

[57] ABSTRACT

Aluminum framing components comprise both a hollow aluminum extrusion and an open back aluminum extrusion which may be used separately or as a system. The hollow aluminum extrusion has a total of three screw bosses, two of which oppose each other on the side walls above the center of gravity of the extrusion. The third screw boss is located in close proximity to the bottom center of the extrusion below the center of gravity of the extrusion. The walls of the three screw bosses are thicker than the nominal wall thickness of the extrusion, and the extrusion walls directly behind the screw bosses are thicker than the walls of the screw bosses. The open back aluminum extrusion has a face with flat, uninterrupted inner and outer surfaces to facilitate placing of the ends of other framing components including the hollow aluminum extrusion of the present invention against the outer surface of the face and the flush mounting of fasteners against the inner surface of the face with the fasteners running through the face into screw bosses in the other framing components.

36 Claims, 3 Drawing Sheets

ALUMINUM FRAMING COMPONENTS AND COMPONENT SYSTEMS FOR POOL, PATIO AND GLASS ENCLOSURES AND THE LIKE

FIELD OF THE INVENTION

This invention generally relates to aluminum framing components and systems including such components for use in the construction of pool, patio and glass enclosures and the like.

BACKGROUND OF THE INVENTION

A variety of different sizes and shapes of aluminum framing components are commonly used in the construction of pool, patio and glass enclosures. Historically 2×2 hollow aluminum extrusions (which typically have outside dimensions of 1.98 inches×1.98 inches) have had the widest applications in these installations, being used in screen enclosures for pools as purlins, chair rails and top rails, and as uprights at corners and around doorways, and being used in screen and glass rooms or patio enclosures as top rails, beams, chair rails and uprights and the like. Of course, standard industry tolerances apply to all extrusion dimensions set forth in this application.

The standard 2×2 hollow aluminum extrusions currently in use have four internal screw bosses, two on each side wall, intended to receive fasteners for anchoring the extrusions to other framing components. A drawback to this design is that sometimes the contractor installs less than four fasteners, which can have an adverse effect on the structural load capacity and thus the span capability of the extrusion. A minimum of three tightly secured fasteners is required to prevent the extrusions from rocking under load.

Another drawback to the standard 2×2 hollow aluminum extrusions is that the fasteners either have a tendency to strip out of the screw bosses, or a twist condition occurs when the fasteners are run into the screw bosses, resulting in noticeable lines in the side walls of the extrusions behind the screw bosses which are unacceptable from an aesthetics standpoint in that the lines make it appear as if the fasteners are breaking out of the extrusion walls.

Another aluminum framing component that is widely used in screened patio and pool enclosures to hold the screens in at the top and bottom edges and at the corners of the enclosure is a 1×2 open back aluminum extrusion, which typically has outside dimensions of 0.990 inch×1.98 inches. The standard 1×2 open back aluminum extrusions include two internal screw bosses that are sometimes used to anchor the extrusions to other framing components. However, the screw bosses in the open back extrusions can be a hindrance especially when attaching the ends of hollow aluminum extrusions to the face of the open back extrusions by running fasteners through the face into the screw bosses in the hollow aluminum extrusions in that the screw bosses in the open back extrusions prevent the fasteners from being flush mounted up against the inside surface of the face of the hollow aluminum extrusions, thus necessitating the use of longer fasteners.

SUMMARY OF THE INVENTION

The present invention relates to certain improvements in the design and construction of the aforementioned aluminum framing components for use in the construction of pool, patio and glass enclosures and systems including such framing components.

In accordance with one aspect of the invention, one of the framing components comprises a hollow aluminum extrusion having a total of three screw bosses instead of the usual four, which not only reduces the cost of the extrusions, but also the cost of the labor and material in installing the extrusions in that only three fasteners have to be installed instead of the usual four.

In accordance with another aspect of the invention, two of the screw bosses oppose each other on the side walls of the hollow aluminum extrusion above the center of gravity of the extrusion, whereas the third screw boss is strategically located in close proximity to the bottom center of the extrusion below the center of gravity of the extrusion to optimize the structural capacity of the extrusion for a given shape and nominal wall thickness, resulting in an improved rigid moment connection with other framing components using a minimal number of fasteners.

In accordance with another aspect of the invention, the nominal wall thickness of the three screw bosses and extrusion walls directly behind the screw bosses are made thicker than the nominal wall thickness of the hollow aluminum extrusion to give the extrusion a greater moment of inertia and section modulus than the standard four screw boss hollow aluminum extrusion with equivalent nominal wall thickness and thus a greater span capability.

In accordance with another aspect of the invention, the increased nominal wall thickness of the screw bosses and walls of the extrusion directly behind the screw bosses allow the nominal wall thickness and thus the cost of the hollow aluminum extrusion to be reduced without adversely affecting the structural integrity of the extrusion profile.

In accordance with another aspect of the invention, the screw bosses in the hollow aluminum extrusion are sized and shaped to prevent a twist condition from occurring and also prevent the fasteners from stripping out of the screw bosses when the fasteners are run into the screw bosses.

In accordance with another aspect of the invention, the nominal wall thickness of the screw bosses and extrusion walls directly behind the screw bosses are made thicker than the nominal wall thickness of the extrusion to provide greater structural integrity to the screw bosses and virtually eliminate any appearance that the fasteners may be breaking out of the walls of the extrusion, thus enhancing the surface condition and overall aesthetics of the extrusion.

In accordance with another aspect of the invention, another framing component comprises an open back aluminum extrusion having a face with flat, uninterrupted inner and outer surfaces to facilitate the flush mounting of fasteners against the inner surface of the face and the running of the fasteners through the face in alignment with screw bosses in the other framing components.

In accordance with another aspect of the invention, the open back aluminum extrusion of the present invention may be secured to the three screw boss hollow aluminum extrusion of the present invention or to other hollow aluminum extrusions as a system with an end of the hollow aluminum extrusions engaging the outer surface of the face of the open back extrusion, and fasteners flush mounted against the inner surface of the face and running through the face into the screw bosses in the hollow aluminum extrusions.

In accordance with another aspect of the invention, the bottom wall screw boss in the hollow aluminum extrusion of the present invention is spaced from the bottom wall by an integral stem to provide clearance for the head and washer of the fastener within the open back aluminum extrusion that runs through the face into the bottom wall screw boss.

In accordance with another aspect of the invention, the side walls of the open back aluminum extrusion of the present invention that extend outwardly from the face have relatively short mounting legs on the outer ends thereof so as not to interfere with the insertion of one of the fasteners through the face into the bottom wall screw boss in the hollow aluminum extrusion.

To the accomplishment of the foregoing and related ends, the invention, then, comprises the features hereinafter fully described and particularly pointed out in the claims, the following description and the annexed drawings setting forth in detail certain illustrative embodiments of the invention, these being indicative, however, of but several of the various ways in which the principles of the invention may be employed.

BRIEF DESCRIPTION OF THE DRAWINGS

In the annexed drawings:

FIG. 2 is an enlarged end view of a standard 2×2 hollow aluminum extrusion used in the construction of pool, patio and glass enclosures and the like;

FIG. 10 is an enlarged end view of a standard 1×2 open back aluminum extrusion used in the construction of pool, patio and glass enclosures and the like;

DETAILED DESCRIPTION OF THE PREFERRED EMBODIMENTS

Figure 1:
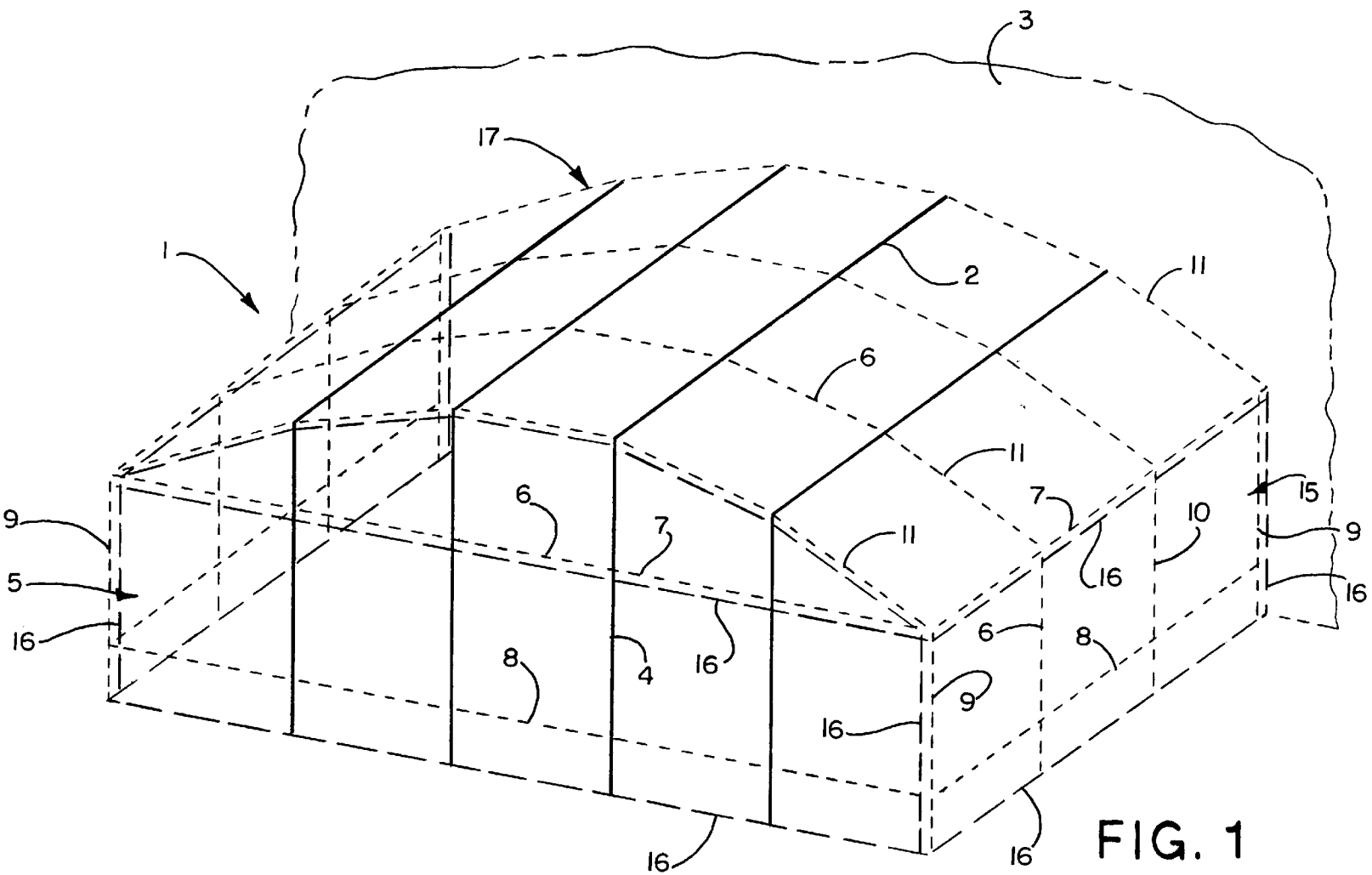
FIG. 1 is a schematic perspective view of one form of enclosure comprised of a plurality of aluminum framing components and component systems.

Referring now in detail to the drawings, and initially to FIG. 1, there is schematically shown one form of pool enclosure 1 constructed of various aluminum framing components including roof beams 2, shown in solid lines in FIG. 1, extending from an existing structure 3 to primary uprights 4, also shown in solid lines, at the front wall 5 of the enclosure. In addition, the enclosure 1 includes numerous 2×2 hollow aluminum extrusions 6, shown in dashed lines, used for top rails 7, chair rails 8, corner posts 9, side wall uprights 10 and purlins 11 to transfer loads and maintain spacing between the primary structural members 2 and 4. Extending along the bottom of the side walls 15 and front wall 5 of the enclosure 1 as well as beneath the top rails 7 and front wall purlins 11 and alongside the corner posts 9 are 1×2 open back aluminum extrusions 16, shown in longer dashed lines in FIG. 1, for use in attaching screens at these points.

The particular enclosure 1 shown in FIG. 1 has a dome shape roof 17. However, it will be appreciated that the roof may be of other shapes including mansard, gable, flat, gable/hip and shed. Moreover, the enclosure may be of other types including patio and glass enclosures and the like.

Figure 2:
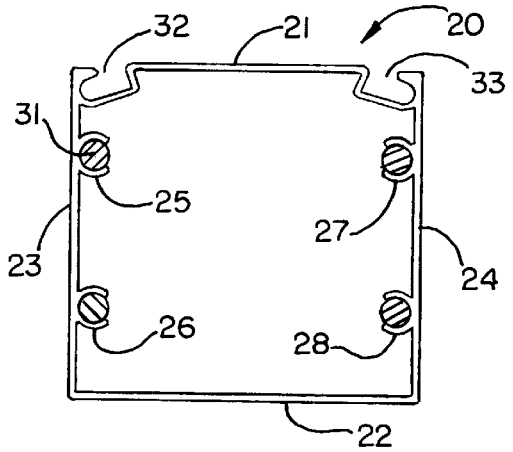
Figure 2A:
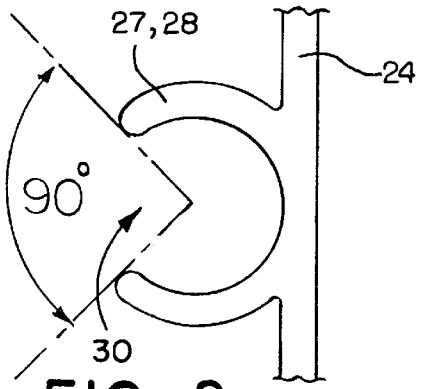
FIG. 2*a* is a further enlarged fragmentary end view of a portion of one of the side walls and one of the screw bosses of the standard hollow aluminum extrusion shown in FIG. 2.

An industry standard 2×2 hollow aluminum extrusion 20 that is commonly used for the hollow aluminum extrusions 6 of FIG. 1 in the construction of pool, patio and glass enclosures is shown in FIG. 2, and includes top and bottom walls 21 and 22 and two side walls 23 and 24. Integral with the inner surfaces of each side wall are two screw bosses 25, 26 and 27, 28. The two screw bosses 25, 26 on side wall 23 are opposite the two screw bosses 27, 28 on the other side wall 24. All four screw bosses 25 through 28 have a nominal wall thickness corresponding to the nominal wall thickness of the extrusion profile, which in most cases is 0.036 inch but in certain applications may be of different nominal wall thicknesses. Also, as best seen in the enlargement of one of the screw bosses in FIG. 2*a*, the nominal thickness of the side walls 23, 24 directly behind the screw bosses 25 through 28 is the same as the nominal wall thickness of the extrusion.

The outside dimensions of the standard 2×2 hollow aluminum extrusion are typically 1.98 inches×1.98 inches. The centers of the two lower and two upper screw bosses 26, 28 and 25, 27 are located 0.552 inch above and below the outer surfaces of the respective bottom and top walls 22 and 21 and 0.120 inch inwardly of the outer surfaces of the side walls 23 and 24. Each screw boss has an inner diameter of 0.168 inch and an opening 30 of 90° for receipt of No. 10 fasteners 31. In the top wall 21 of the extrusion 20 are two spline grooves 32, 33 for rolling of splined edges of screens into the grooves.

A drawback to the industry standard hollow aluminum extrusion 20 shown in FIG. 2 is that sometimes the contractor installs fasteners in less than all four of the screw bosses 25 through 28, which can have an adverse effect on the structural load capacity and thus the span capability of the extrusion. Moreover, there is a tendency for the fasteners 31 either to strip out of the screw bosses, or to produce a twist condition when the fasteners are run into the screw bosses, resulting in noticeable lines in the side walls 23, 24 of the extrusions 20 directly behind the screw bosses, giving the appearance that the fasteners are breaking out of the extrusion profile.

Figure 3:
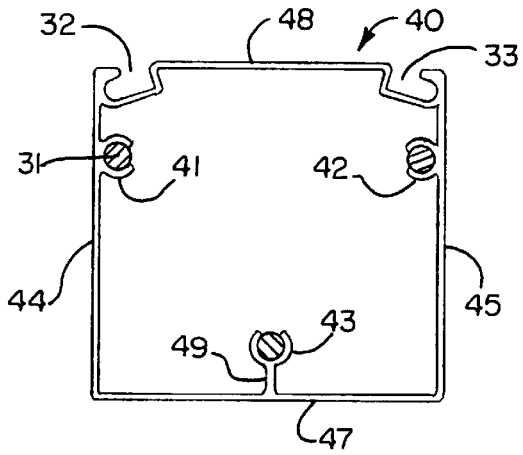
FIG. 3 is an enlarged end view of an improved 2×2 hollow aluminum extrusion in accordance with the present invention.

To overcome these objections, a 2×2 hollow aluminum extrusion 40 in accordance with this invention is shown in FIG. 3, which only has three internal screw bosses 41, 42 and 43 instead of the usual four. Two of the screw bosses 41 and 42 are integrally formed on the inner surfaces of the two side walls 44 and 45 above the center of gravity of the extrusion, similar to the upper pair of screw bosses 25 and 27 of the standard hollow aluminum extrusion 20 shown in FIG. 2. However, the third screw boss 43 is integrally connected to the bottom wall 47 of the extrusion 40 intermediate the width thereof so as to locate the center of the third screw boss 43 further below the center of gravity of the extrusion 40 than the other two screw bosses 26 and 28 of the standard extrusion 20.

In the preferred embodiment disclosed herein, the outer dimensions of the hollow aluminum extrusion are 1.98 inches×1.98 inches, and the centers of the two side wall screw bosses 41 and 42 are located 0.552 inch from the outer surface of the top wall 48, which is the same as the upper two side wall screw bosses 25 and 27 of the standard extrusion 20. However, the center of the third screw boss 43 is 0.324 inch above the outer surface of the bottom wall 47, leaving a moment arm of 1.104 inch between the two upper side wall screw bosses 41 and 42 and bottom wall screw boss 43. In contrast, the centers of the lower two side wall screw bosses 26 and 28 of the standard extrusion 20 are 0.552 inch above the outer surface of the bottom wall 22, leaving a moment arm of 0.876 inch between the two pairs of side wall screw bosses on opposite sides of the center of gravity of the extrusion.

Providing a single screw boss at the center of the bottom wall of the extrusion maximizes the moment arm between the screw bosses on opposite sides of the center of gravity of the extrusion, thus optimizing the structural capacity of the extrusion for a given shape and nominal wall thickness resulting in an improved rigid moment connection with other framing components. Also, locating the three screw bosses on three of the walls instead of the usual four on two of the walls insures that the contractor will install fasteners in all three screw bosses. Moreover, providing only three screw bosses instead of the usual four lowers the cost of the extrusions and number of fasteners required to anchor the extrusions and thus the length of time it takes to anchor the extrusions in place resulting in a savings of both labor and material.

Figure 3A:
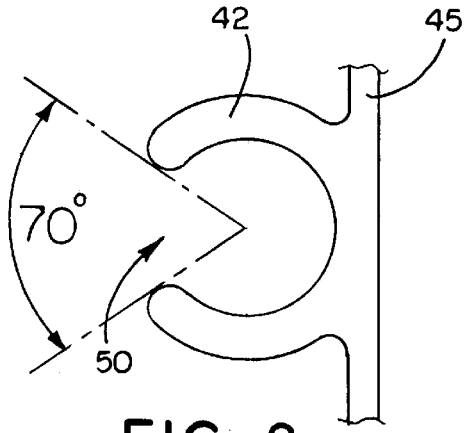
FIG. 3*a* is a further enlarged fragmentary end view of a portion of one of the side walls and one of the screw bosses of the hollow aluminum extrusion shown in FIG. 3.

As shown in the FIG. 3*a* enlargement of one of the walls of the extrusion 40 of FIG. 3, the nominal wall thickness of the screw bosses 41, 42 and 43 of the hollow aluminum extrusion 40 of the present invention and extrusion walls directly behind the screw bosses are greater than the nominal wall thickness of the extrusion. This gives the extrusion a greater moment of inertia and section modulus and thus a greater span capability than the standard four screw boss hollow aluminum extrusion 20 shown in FIG. 2 with an equivalent nominal wall thickness. Moreover, increasing the nominal wall thickness of the screw bosses and walls of the extrusion directly behind the screw bosses allows the nominal wall thickness of the hollow aluminum extrusion to be reduced to provide a cost savings without adversely affecting the structural integrity of the extrusion profile.

In the preferred embodiment disclosed herein, the nominal wall thickness of the screw bosses 41, 42 and 43 of the extrusion 40 has been increased from the standard nominal 0.036 screw boss thickness to 0.040 inch. Also, the nominal wall thickness of the extrusion 40 has been reduced from 0.036 inch to 0.032 inch whereas the nominal wall thickness directly behind the side wall screw bosses 41 and 42 has been increased to 0.044 inch, to make it somewhat thicker than the screw boss nominal wall thickness. Moreover, the centers of the two side wall screw bosses 41 and 42 are located 0.128 inch from the outer surface of the side walls 44 and 45.

The bottom wall screw boss 43 is connected to the center of the bottom wall 47 of the extrusion 40 by an integral stem 49 that also increases the nominal wall thickness of the extrusion directly behind the bottom wall screw boss. The stem 49 has a nominal wall thickness of 0.040 inch and radiused corners where the stem connects to the screw boss 43 and bottom wall 47.

The inside diameters of the thicker walled screw bosses 41, 42 and 43 of the present invention have been increased slightly from the standard 0.168 inch inside diameter screw bosses to 0.170 inch to provide some relief for the No. 10 fasteners 31 that are normally used to anchor the hollow aluminum extrusions in place. This helps prevent a twist condition from occurring which is possible when No. 10 fasteners are run into the smaller inside diameter screw bosses. Also, a 70° opening 50 is provided in the walls of the screw bosses as schematically shown in FIG. 3*a* which is enough to allow the fasteners 31 to run easily into the screw bosses and still have the screw bosses sufficiently closed around the fasteners to help prevent the fasteners from stripping out of the screw bosses thereby resulting in better anchoring of the fasteners in the screw bosses. Moreover, the larger inside diameter screw bosses and 70° openings in the screw bosses in conjunction with the greater wall thickness of the screw bosses and the walls directly behind the screw bosses cooperate to eliminate any noticeable lines that sometimes occur behind the screw bosses in the standard hollow aluminum extrusions, which are aesthetically undesirable because they make it appear as if the fasteners are breaking out of the walls of the screw bosses.

Figure 4:
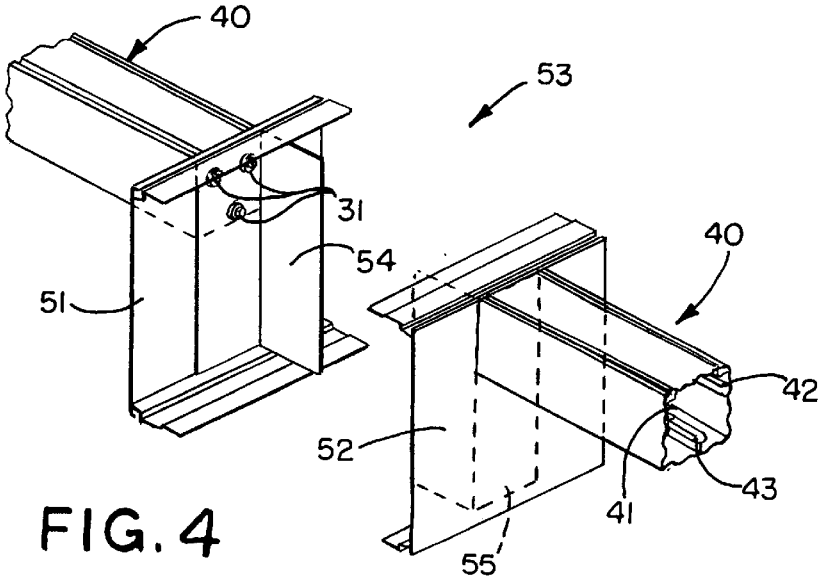
FIG. 4 is a fragmentary perspective view showing two hollow aluminum extrusions in accordance with the present invention anchored to two extruded aluminum sections of a self mating beam prior to mating the two extruded sections together.
Figure 5:
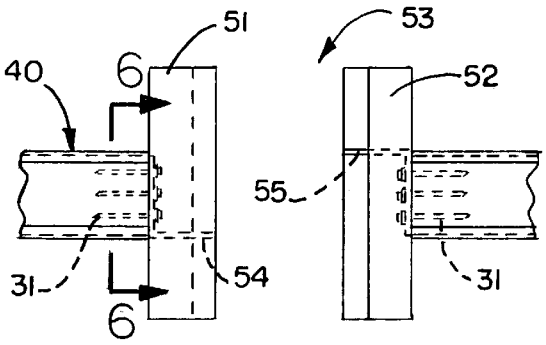
FIG. 5 is a top plan view of the two hollow aluminum extrusions and two extruded sections of FIG. 4.
Figure 6:
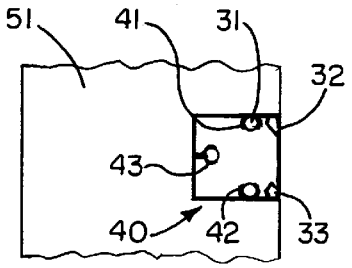
FIG. 6 is a transverse section through one of the hollow aluminum extrusions of FIG. 5 taken on the plane of the line 6—6 thereof.

FIGS. 4 through 6 schematically show the ends of two hollow aluminum extrusions 40 in accordance with the present invention anchored to two extruded aluminum sections 51 and 52 of a snap extrusion or of a self mating beam 53 prior to mating the two extruded sections together using three fasteners 31 extending through the sections into the three screw bosses 41 through 43 to make a rigid moment connection between these components of the structural frame. Suitable internal bracing in the form of extruded angles 54 and 55 are provided between the extruded aluminum sections 51 and 52 at the locations where the hollow aluminum extrusions 40 are anchored to the beam sections.

Figure 7:
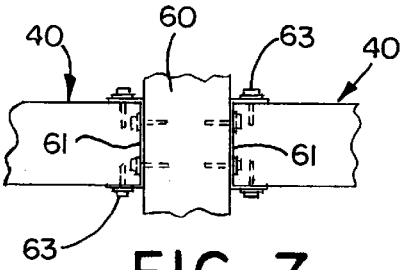
FIGS. 7 and 8 are fragmentary side elevation views showing two different ways of attaching two hollow aluminum extrusions in accordance with the present invention to opposite sides of another hollow aluminum extrusion.
Figure 8:
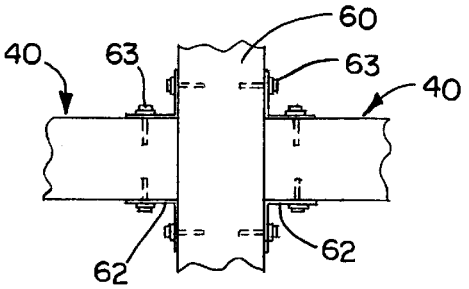

In some applications the ends of two hollow aluminum extrusions 40 of the present invention are anchored in line to opposite sides of other hollow aluminum extrusions 60 by attaching U clips 61 or angles 62 to opposite sides of the hollow aluminum extrusions 60 using suitable fasteners 63 and then inserting the ends of the hollow aluminum extrusions 40 into the U clips 61 or between the angles 62 and attaching the U clips/angles to opposite sides of the hollow aluminum extrusions 40 using additional fasteners 63 as schematically shown in FIGS. 7 and 8.

Figure 9:
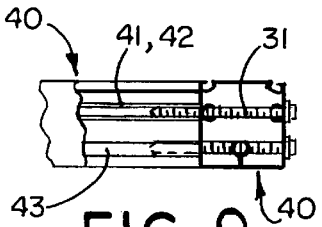
FIG. 9 is a fragmentary sectional view showing a hollow aluminum extrusion of the present invention connected to one side of an other hollow aluminum extrusion by running fasteners through the other hollow aluminum extrusion into three screw bosses in the hollow aluminum extrusion.

In other applications the ends of the hollow aluminum extrusions 40 of the present invention are anchored to one side only of other hollow aluminum extrusions 40 by running three fasteners 31 through the other hollow aluminum extrusions into the three screw bosses 41, 42 and 43 in the hollow aluminum extrusions of the present invention as schematically shown in FIG. 9.

Figure 10:
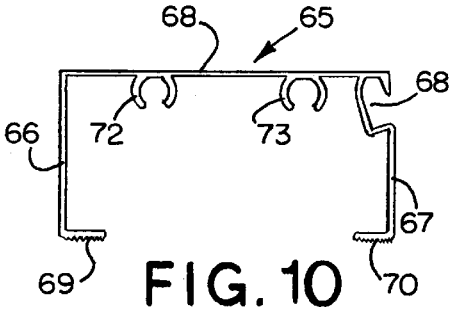
Figure 10A:
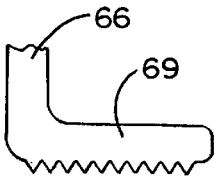
FIG. 10*a* is a further enlarged end view of one of the mounting legs of the open back aluminum extrusion of FIG. 10.

In still other applications the hollow aluminum extrusions 40 of the present invention are anchored to open back aluminum extrusions by running fasteners through the face of the open back aluminum extrusions into the screw bosses in the hollow aluminum extrusions. FIG. 10 shows a standard 1×2 open back aluminum extrusion 65 including a pair of side walls 66, 67 extending perpendicularly from the face 68 and a pair of relatively short inturned legs 69 and 70 on the outer ends of the side walls defining the open back 71. One of the side walls 67 has a spline groove 68 in the outer surface thereof to permit the splined edge of a screen (not shown) to be rolled into the spline groove.

On the inner surface of the face 68 of the open back extrusion 65 are a pair of screw bosses 72 and 73 at may be used to anchor the ends of the open back extrusions to other framing components by running fasteners through the other framing components into the screw bosses in the open back extrusions. However, since the open back aluminum extrusions are primarily used to hold screens on the outside of the enclosure, the open back aluminum extrusions are commonly secured to other structural components or existing structures simply by running suitable fasteners through the face of the open back aluminum extrusions into the other structure components or existing structures. Moreover, these screw bosses 72 and 73 can be a hindrance when attaching the ends of hollow aluminum extrusions 40 to the face of open back aluminum extrusions in that the screw bosses on the open back aluminum extrusions prevent the heads and washers of the fasteners from being mounted flush against the inside surface of the face as further shown in FIG. 11, thus necessitating the use of longer fasteners than would otherwise be required.

Figure 11:
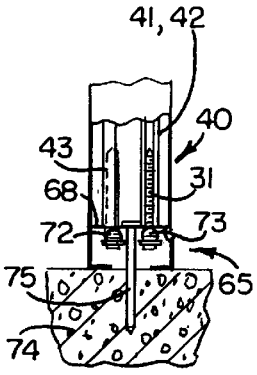
FIG. 11 is a fragmentary section showing one end of a hollow aluminum extrusion in accordance with the present invention attached to the face of a standard open back aluminum extrusion which is in turn attached to an existing support structure.

The open back aluminum extrusion 65 may be attached to a concrete base 74 or other existing structure after the hollow aluminum extrusions are secured to the open back aluminum extrusion by running suitable fasteners 75 through the face of the open base aluminum extrusion in spaced relation from the hollow aluminum extrusions and into the existing structure as further schematically shown in FIG. 11.

Figure 12:
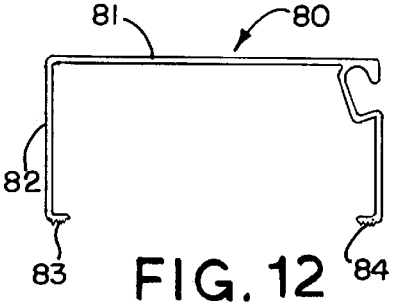
FIG. 12 is an enlarged end view of an improved 1×2 open back aluminum extrusion in accordance with the present invention.
Figure 13:
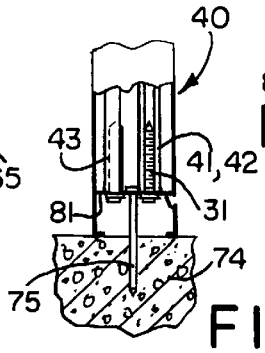
FIG. 13 is a fragmentary section showing one end of a hollow aluminum extrusion in accordance with the present invention attached to the face of an open back aluminum extrusion of the present invention which is in turn attached to an existing support structure.

A 1×2 open back aluminum extrusion 80 in accordance with the present invention is shown in FIG. 12 which is similar to the standard open back aluminum extrusion 65 shown in FIG. 10 including the same outside dimensions of 0.990 inch×1.98 inches. Also, the nominal wall thickness of the extrusion 80 may be the same as the standard extrusion 65 which in most cases is 0.036 inch but in certain applications may be of different nominal wall thicknesses. However, the internal screw bosses have been eliminated from the open back aluminum extrusion 80 of the present invention in order to provide a flat, uninterrupted inner surface on the face 81 of the open back aluminum extrusion. This makes it easier to drill fastener holes through the face in alignment with the screw bosses 41–43 in the hollow aluminum extrusions 40. Also this provides for the flush mounting of the heads and washers of the fasteners 31 against the inner surface of the face 81 of the hollow aluminum extrusion as schematically shown in FIG. 13, resulting in a stronger, more positive connection between the open back aluminum extrusion 80 and the hollow aluminum extrusions 40. Moreover, shorter fasteners 31 having a length for example of 1×2 inches may be used to anchor hollow aluminum extrusions 40 to the open back aluminum extrusions 80 instead of the usual 2 inch fasteners.

Figure 12A:
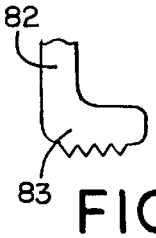
FIG. 12*a* is a further enlarged end view of one of the mounting legs of the open back aluminum extrusion of FIG. 12.
Figure 14:
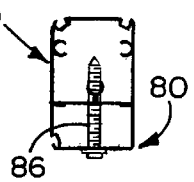
FIG. 14 is an end view showing an open back aluminum extrusion of the present invention attached to a hollow aluminum extrusion of the present invention by running fasteners through the face of the open back aluminum extrusion into the bottom wall of the hollow aluminum extrusion.

For ease of anchoring the hollow aluminum extrusions 40 of the present invention to the face 81 of the 1×2 open back aluminum extrusion 80 of the present invention, it is important to space the bottom wall screw boss 43 of the hollow aluminum extrusions 40 sufficiently inwardly from the bottom wall 47 in order to provide room for the head and washer of the fasteners 31 extending through the face of the open back aluminum extrusion into the bottom wall screw boss. Also, the width of the inturned legs 83 and 84 of the open back aluminum extrusion 80 of the present invention are reduced from the standard 0.250 inch width as schematically shown in FIGS. 10, 10*a* and 11 to 0.120 inch as schematically shown in FIGS. 12, 12*a* and 13 so that the legs do not interfere with the running of the fasteners through the face of the open back extrusion into the bottom wall screw boss. FIG. 14 shows the open back aluminum extrusion 80 of the present invention attached to the hollow aluminum extrusion 40 of the present invention by running suitable length fasteners 80 through the face of the open back aluminum extrusion into the bottom wall of the hollow aluminum extrusion.

Although the invention has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the claims.

What is claimed is:

1. An aluminum framing component for use in constructing pool, patio and glass enclosures comprising a hollow aluminum extrusion having top and bottom walls and two side walls, and only three longitudinally extending internal screw bosses engageable by fasteners for securing said framing component to other framing components, one of said screw bosses being integral with an inner surface of said bottom wall intermediate a width of said bottom wall below the center of gravity of said extrusion, and the other two screw bosses being integral with inner surfaces of said side walls above the center of gravity of said extrusion.

2. The aluminum framing component of claim 1 wherein said screw bosses have a nominal wall thickness that is greater than the nominal wall thickness of said extrusion.

3. The aluminum framing component of claim 1 wherein said side wall screw bosses directly oppose each other on said side walls.

4. The aluminum frame component of claim 1 wherein the nominal wall thickness of said side walls where said side wall screw bosses are joined to said side walls is greater than the nominal wall thickness of said extrusion.

5. The aluminum framing component of claim 4 wherein the nominal wall thickness of said side wall screw bosses is greater than the nominal wall thickness of said extrusion and less than the nominal wall thickness of said side walls where said side wall screw bosses are joined to said side walls.

6. The aluminum framing component of claim 1 wherein said bottom wall screw boss is spaced from said bottom wall by a stem that is integral with said bottom wall screw boss and said bottom wall.

7. The aluminum framing component of claim 1 wherein said screw bosses have an inner diameter of 0.170 inch and a 70° opening to reduce the tension of said screw bosses when No. 10 fasteners are run into said screw bosses.

8. The aluminum framing component of claim 1 wherein said extrusion is a 2×2 extrusion having outside dimensions of 1.98 inches×1.98 inches and a nominal wall thickness of 0.032 inch, and said screw bosses have a nominal wall thickness of 0.040 inch.

9. The aluminum framing component of claim 8 wherein the nominal wall thickness where said side wall screw bosses are joined to said side walls is 0.044 inch.

10. The aluminum framing component of claim 8 wherein said bottom wall screw boss is spaced from said bottom wall by a stem that integrally connects said bottom wall screw boss to said bottom wall, said stem having a nominal wall thickness of 0.040 inch.

11. The aluminum framing component of claim 10 wherein the center of said bottom wall screw boss is spaced 0.324 inch from an outer surface of said bottom wall.

12. The aluminum framing component of claim 1 wherein said top wall has an outer surface containing two spline grooves for rolling a screen edge into said spline grooves.

13. An aluminum framing component for use in constructing pool, patio and glass enclosures comprising a hollow aluminum extrusion having top and bottom walls and two side walls and longitudinally extending internal screw bosses formed on inner surfaces of a plurality of said walls, said screw bosses having a greater nominal wall thickness than the nominal wall thickness of said extrusion.

14. The aluminum framing component of claim 13 wherein the nominal wall thickness of said extrusion where said screw bosses are joined to said walls is greater than the nominal wall thickness of said extrusion.

15. The aluminum framing component of claim 14 wherein the nominal wall thickness of said extrusion where said screw bosses are joined to said walls is greater than the nominal wall thickness of said screw bosses.

16. The aluminum framing component of claim 13 wherein said screw bosses have an inner diameter of 0.170 inch and a 70° opening to reduce the tension in said screw bosses when No. 10 fasteners are run into said screw bosses.

17. The aluminum framing component of claim 13 wherein said extrusion is a 2×2 hollow aluminum extrusion having outside dimensions of 1.98 inches×1.98 inches and a nominal wall thickness of 0.032 inch, the nominal wall thickness of said screw bosses is 0.040 inch, and the nominal wall thickness of said extrusion where said screw bosses are joined to said walls is greater than the nominal wall thickness of said extrusion.

18. The aluminum framing component of claim 17 wherein said extrusion has only three of said screw bosses, two of said screw bosses being integral with said side walls, and one of said screw bosses being integral with said bottom wall.

19. The aluminum framing component of claim 18 wherein said side wall screw bosses are joined directly to said side walls, and said bottom wall screw boss is spaced from said bottom wall by a stem integrally connecting said bottom wall screw boss to the midpoint of a width of said bottom wall.

20. An aluminum framing component for use in constructing pool, patio and glass enclosures comprising an open back aluminum extrusion having a face, two side walls and an open back, said face having flat, uninterrupted inner and outer surfaces to facilitate placing of other framing components against said outer surface and the flush mounting of fasteners against said inner surface of said face with said fasteners extending through said face into threaded engagement with such other framing components.

21. The aluminum framing component of claim 20 further comprising mounting legs on ends of said side walls remote from said face, said extrusion having outside dimensions of 0.990 inch×1.98 inches, and said legs having a length of 0.120 inch.

22. The aluminum framing component of claim 21 wherein said extrusion has a nominal wall thickness of 0.036 inch.

23. The aluminum framing component of claim 20 wherein one of said side walls has an external spline groove for rolling of a screen edge into said spline groove.

24. A system of aluminum framing components for use in constructing pool, patio and glass enclosures comprising a hollow aluminum extrusion having top and bottom walls and two side walls, and a plurality of longitudinally extending internal screw bosses, and an open back aluminum extrusion having a face and two sides extending perpendicular to said face, and spaced apart inturned mounting legs on ends of said sides remote from said face, said face having flat, uninterrupted inner and outer surfaces, one end of said hollow aluminum extrusion engaging said outer surface of said face, and a plurality of fasteners extending through said face into said screw bosses in said hollow aluminum extrusion for securing said hollow aluminum extrusion to said open back aluminum extrusion, said fasteners being flush mounted against said inner surface of said face.

25. The system of claim 24 wherein said fasteners have a length less than 2 inches.

26. The system of claim 25 wherein said fasteners have a length of 1½ inches.

27. The system of claim 24 wherein said fasteners have heads and washers that are flush mounted against said inner surface of said face. the center of gravity of said hollow aluminum extrusion, said open back aluminum extrusion having three fasteners extending through said face into said three screw bosses in said hollow aluminum extrusion for securing said hollow aluminum extrusion to said open back aluminum extrusion, said three fasteners being flush mounted against said inner surface of said face.

28. The system of claim 24 wherein said hollow aluminum extrusion has only three longitudinally extending internal screw bosses, one of said screw bosses being integral with an inner surface of said bottom wall intermediate a width of said bottom wall below the center of gravity of said hollow aluminum extrusion, and the other two screw bosses being integral with inner surfaces of said side walls above the center of gravity of said hollow aluminum extrusion, said open back aluminum extrusion having three fasteners extending through said face into said three screw bosses in said hollow aluminum extrusion for securing said hollow aluminum extrusion to said open back aluminum extrusion, said three fasteners being flush mounted against said inner surface of said face.

29. The system of claim 28 wherein said bottom wall screw boss is spaced from said bottom wall of said hollow aluminum extrusion by a stem integrally connecting said bottom wall screw boss to said bottom wall to provide clearance for the head and washer of said fastener extending through said face of said open back aluminum extrusion into said bottom wall screw boss.

30. The system of claim 29 wherein said hollow aluminum extrusion is a 2×2 extrusion having two spline grooves in the outer surface of said top wall, and the axial center of said bottom wall screw boss is spaced inwardly from said bottom wall 0.324 inch, and said open back aluminum extrusion is a 2×1 extrusion having a spline groove in the outer surface of one of said sides of said open back aluminum extrusion, and said legs having a length of 0.120 inch so as not to interfere with the running of one of said fasteners through said face into said bottom wall screw boss.

31. The system of claim 30 wherein said fasteners are No. 10 fasteners, and said screw bosses in said hollow aluminum extrusion have an inner diameter of 0.170 inch and a 70° opening to reduce the tension in the walls of said screw bosses caused by said fasteners.

32. The system of claim 30 wherein said hollow aluminum extrusion has a nominal wall thickness of 0.032 inch and said screw bosses have a nominal wall thickness of 0.040 inch.

33. The system of claim 32 wherein said hollow aluminum extrusion has a nominal wall thickness where said side wall screw bosses are joined to said side walls of 0.044 inch.

34. A system of aluminum framing components for use in the construction of pool, patio and glass enclosures comprising a hollow aluminum extrusion having top and bottom walls and two side walls, and only three longitudinally extending internal screw bosses, one of said screw bosses being integral with an inner surface of said bottom wall intermediate a width of said bottom wall below the center of gravity of said hollow aluminum extrusion, and the other two screw bosses being integral with inner surfaces of said side walls above the center of gravity of said hollow aluminum extrusion, and an other aluminum framing component secured to said hollow aluminum extrusion by three fasteners extending through portions of said other aluminum framing component into said three screw bosses in said hollow aluminum extrusion.

35. The system of claim 34 wherein said other aluminum framing component is an other hollow aluminum extrusion, said three fasteners extending completely through said other hollow aluminum extrusion into said three screw bosses in said hollow aluminum extrusion.

36. The system of claim 34 wherein said other aluminum framing component comprises two extruded aluminum sections mated together, said three fasteners extending through one of said extruded aluminum sections into said three screw bosses in said hollow aluminum extrusion.

* * * * *